United States Patent [19]

Swiatosz

[11] Patent Number: 4,764,660

[45] Date of Patent: Aug. 16, 1988

[54] ELECTRIC SMOKE GENERATOR

[75] Inventor: Edmund Swiatosz, Maitland, Fla.

[73] Assignee: The United States of America as represented by the Secretary of the Navy, Washington, D.C.

[21] Appl. No.: 790,028

[22] Filed: Oct. 22, 1985

[51] Int. Cl.[4] ..... H05B 1/02; H05B 3/42; B01J 13/00; F22B 1/28

[52] U.S. Cl. ..... 219/272; 219/273; 219/275; 219/300; 219/308; 219/505; 239/136; 261/142

[58] Field of Search ..... 219/300, 275, 271–273, 219/308, 504, 505; 261/142; 239/136

[56] References Cited

U.S. PATENT DOCUMENTS

| | | | |
|---|---|---|---|
| 1,190,167 | 7/1916 | Hill | 219/300 |
| 2,882,240 | 4/1959 | Charwat . | |
| 3,234,357 | 2/1966 | Seuthe | 219/273 |
| 3,250,723 | 5/1966 | Fortney . | |
| 3,780,250 | 12/1973 | Ando | 219/300 X |
| 3,851,146 | 11/1974 | Bennett | 219/300 |
| 3,990,987 | 11/1976 | Rogers | 219/300 |
| 4,326,119 | 4/1982 | Swiatosz | 219/272 |
| 4,349,723 | 9/1982 | Swiatosz | 219/271 |
| 4,477,395 | 10/1984 | Albarda | 261/131 |
| 4,547,656 | 10/1985 | Swiatosz et al. | 219/300 |
| 4,568,820 | 2/1986 | Swiatosz | 219/300 X |

*Primary Examiner*—Anthony Bartis
*Attorney, Agent, or Firm*—Robert W. Adams

[57] ABSTRACT

A high output smoke generator suitable for use as a portable apparatus employs a thin-walled metal conduit as a resistance heater coil which also doubles as a thermal sensor. A balance bridge controller using the coil as one leg in the bridge network, is electrically coupled to provide current to the resistance heater coil for maintaining the coil at a predetermined temperature. A thermocouple used for calibration is electrically isolated from the coil by a beryllium oxide disk. Also, disclosed are a fluid reservoir and pump to provide smoke generating fluid to the coil after an adjustable time delay from startup, and a timer to shutdown operation after a preselected period.

5 Claims, 2 Drawing Sheets

ELECTRIC SMOKE GENERATOR

BACKGROUND OF THE INVENTION

1. Field of the Invention

The present invention relates generally to training devices. In particular, this invention relates to a training device for simulating the smoke of a fire, although it is appropriate for any nontoxic cloud forming application.

2. Description of the Prior Art

A variety of training devices are available for generating nontoxic smoke so as to teach a student how to handle a fire under realistic conditions. One such device of the prior art simulates smoke by utilizing steam admixed with an organic liquid so as to produce a vaporized organic liquid, and forcing the vaporized organic liquid through a narrow orifice into the atmosphere so that the vapor is rapidly chilled. While performing satisfactorily for its intended purpose of generating smoke, this device of the prior art ordinarily leaves something to be desired, especially from the standpoints of design complexity, cost effectiveness, energy utilization efficiency and physical size.

In addition, there are commercially available a variety of smoke bombs or smoke grenades for generating smoke so as to teach the student how to handle a fire. While working well for their intended purpose of producing smoke, these devices of the prior art ordinarily leave something to be desired from the standpoints of cost effectiveness and personal safety, in that the smoke produced thereby may be highly toxic.

U.S. Pat. No. 2,882,240 to Charwat discloses a smoke generator primarily for use in a wind tunnel, that heats oil to a temperature below its boiling point and plays cool air over the oil to condense the vapor. The resulting smoke is removed through tubes of relatively large diameter.

U.S. Pat. No. 3,234,357 to Seuthe discloses an electrically heated smoke producing device in which a tubular element having a capillary bore through which an electrical heating element extends that is suspended in a liquid which will vaporize to form smoke when heated.

U.S. Pat. No. 3,250,723 to Fortney discloses a portable smoke generator that has a converter element which is heated, and sprayed with a smoke-producing fuel. A stream of air is directed by the converter to cause movement of the smoke from the converter.

U.S. Pat. No. 4,326,119 to the present inventor is the most relevant art. It discloses a portable battery-powered electric smoke generator for simulating the smoke of a fire for training purposes, that includes a tubular housing enclosing a rechargeable battery power supply having terminals connected to the ends of a tubular metallic coil filled with a vaporizable smoke producing liquid. One end of the tubular coil communicates with a smoke discharge port at one end of the housing. The discharge port is sealed by a fusible disk and communicates with an apertured smoke release cup. An electric switch arrangement, either thermal or electronic, is provided on the housing in the circuit between the coil and power supply for energizing the tubular coil for a time sufficient to superheat the vaporizable liquid therein. The heat of the tubular coil melts the fusible disk to release the superheated liquid through the smoke release cap into the atmosphere as a vapor simulating smoke. The liquid may be mineral oil, polyethylene glycol or propylene glycol.

U.S. Pat. No. 4,349,723 to the present inventor discloses a nontoxic smoke generator for simulating the smoke of a fire, that includes an inner cylindrical shell surrounded in spaced relation by a thermally insulated outer casing to form an air flow passage therebetween through which compressed air heated by electric air heaters is caused to flow in a helical pattern to heat the shell to a temperature above the vaporization temperature of a vaporizable smoke substance. The smoke substance, such as propylene glycol, polyethylene glycol 200 or mineral oil, is pumped from a reservoir through a supply pipe having a coiled preheating portion disposed in the space between the shell and housing and is sprayed through a wide spray atomizing nozzle into heated vaporization chamber where it is vaporized and discharged as non-toxic smoke.

U.S. Pat. No. 4,477,395 to Albarda discloses apparatus for admixing liquid anesthetics and respiratory gas to be supplied to a patient. The apparatus comprises a mixing chamber having an inlet for receiving the liquid anesthesia and the respiratory gas, and an outlet for supplying the mixture. A feed line is provided in the inlet for the liquid anesthesia, with a heat exchanger for equalizing the inlet temperatures of the anesthesia and respiratory gas. Temperature sensors are provided in the inlet and the outlets with a circuit for determining the difference between the temperatures. Without heating of the chamber this difference is proportional to a ratio between the evaporated anesthetic and respiratory gas. With the chamber heated to equate the inlet and outlet temperatures, the amount of heating is proportional to the flow of anesthetic to the chamber.

SUMMARY OF THE INVENTION

The present invention overcomes disadvantages of the prior art in that it comprises an optimized and relatively simple portable smoke generator which produces a nontoxic smoke.

Included in the present invention is a long, coiled, thin-walled tube encapsulated in a ceramic heat shield, utilized as a single element smoke generator system. The tube serves as an electrical resistance heating element to distribute heat uniformally along the length of the tube, and as a conduit and heat exchanger for the smoke agent material which is heated to vaporization. The tube also acts as a temperature sensing element in conjunction with a temperature controller which maintains the appropriate set temperature in the tube by use of a balance bridge circuit. Smoke particulates are produced by condensation of the superheated vapors in the ambient air. A beryllium oxide ceramic disk is attached to the tube to provide electrical isolation and thermal conduction to a thermocouple used for calibration. Also, included are a time delay circuit for preheating the tube, and an adjustable shut-off timer.

DESCRIPTION OF A PREFERRED EMBODIMENT

Figure 1:
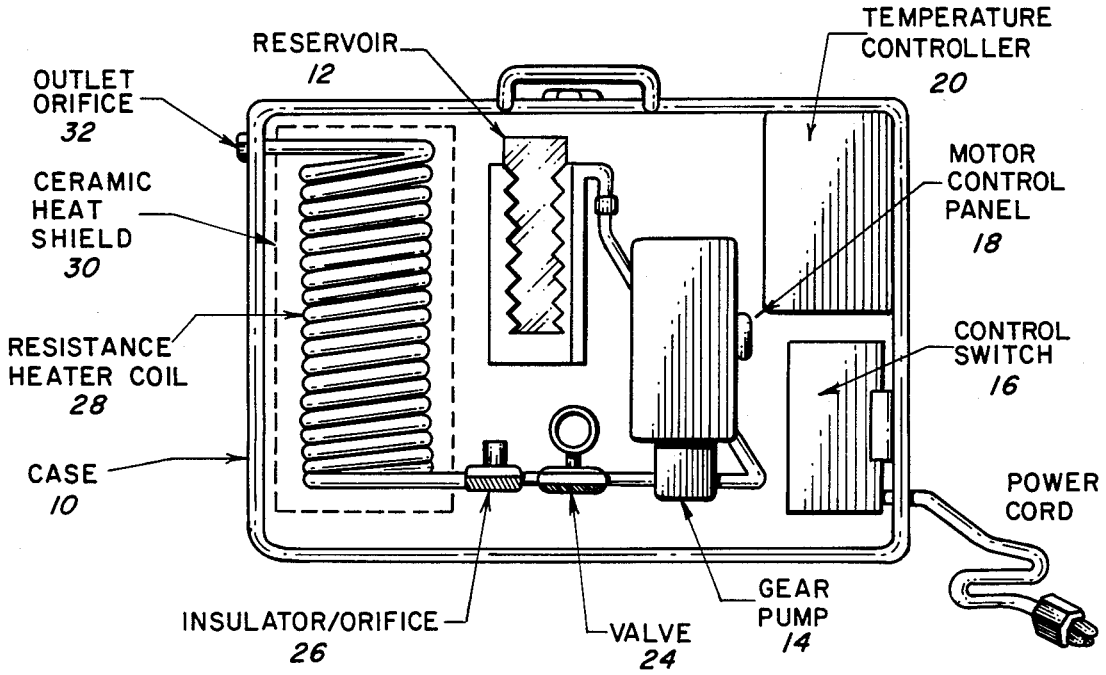
FIG. 1 is a pictorial representation of the basic components of the fluid handling means of the present invention.

A preferred embodiment of the present invention will now be discussed in some detail in conjunction with all of the views of the drawing, wherein like parts are designated by like reference numerals.

FIG. 1 shows portable case housing 10 in which the present invention is arranged. Included are fluid reservoir 12 that is removable for easy refilling. The capacity of reservoir 12 will restrict the duration of the smoke providing period. A 500 ml capacity will provide approximately 4000 cfm of smoke for ten minutes. Reservoir 12 includes an internal bladder with one side vented to permit operation of the apparatus in any orientation. In general, the application requirement will determine the choice of smoke agent material. Aircraft evacuation simulators and cockpit trainers require a non-toxic and non-residue material such as propylene glycol. A more persistant smoke material, such as non-toxic and water soluble polyethylene glycol 200, would be more suitable for some shipboard drills. Various blends of propylene glycol, PEG 200 and water may be tried, as well as other non-toxic smoke agents. Propylene glycol is a preferred material for use with the present invention.

Motor driven gear pump 14 has its fluid input coupled by conduit to the output of reservoir 12. Pump 14 is electrically driven, and controlled by the circuit shown in FIG. 2. Major portions of the electrical circuit are shown at control switch 16, motor control panel 18 and temperature controller 20. Pump 14 is preferably a magnetic drive gear pump having a capacity for providing 60 ml per minute at 60 psi. A variable output that is proportional to the applied voltage is provided and regulated by high/low capacity switch 22 shown on FIG. 2.

Solenoid valve 24 is included to prevent leakage of the smoke agent through the system during storage and transport. A pressure gauge, not shown, may also be included in the conduit at this stage to monitor the fluid pressure downstream from the pump, and is recommended.

Fixed orifice 26 in the a conduit downstream of the gear pump couples the conduit to resistance heater coil 28. Orifice 26 is selected to establish a predetermined fluid pressure and flow. Also, it electrically insulates the heater from chassis ground.

Resistance heater coil 28 preferably is potted in ceramic heat shield 30. Resistance heater coil 28 serves as a combination heater, flow conduit heat exchanger and temperature control sensing element. The smoke agent is pumped through the coil whereat it is superheated to a vapor, and is provided at outlet orifice 32. When the superheated vapors are cooled in the ambient air and condensed into smoke particles, a dense smoke is formed. The output smoke capacity can be regulated by selecting the position of switch 22 to operate pump 14 either at high speed or at low speed.

Figure 2:
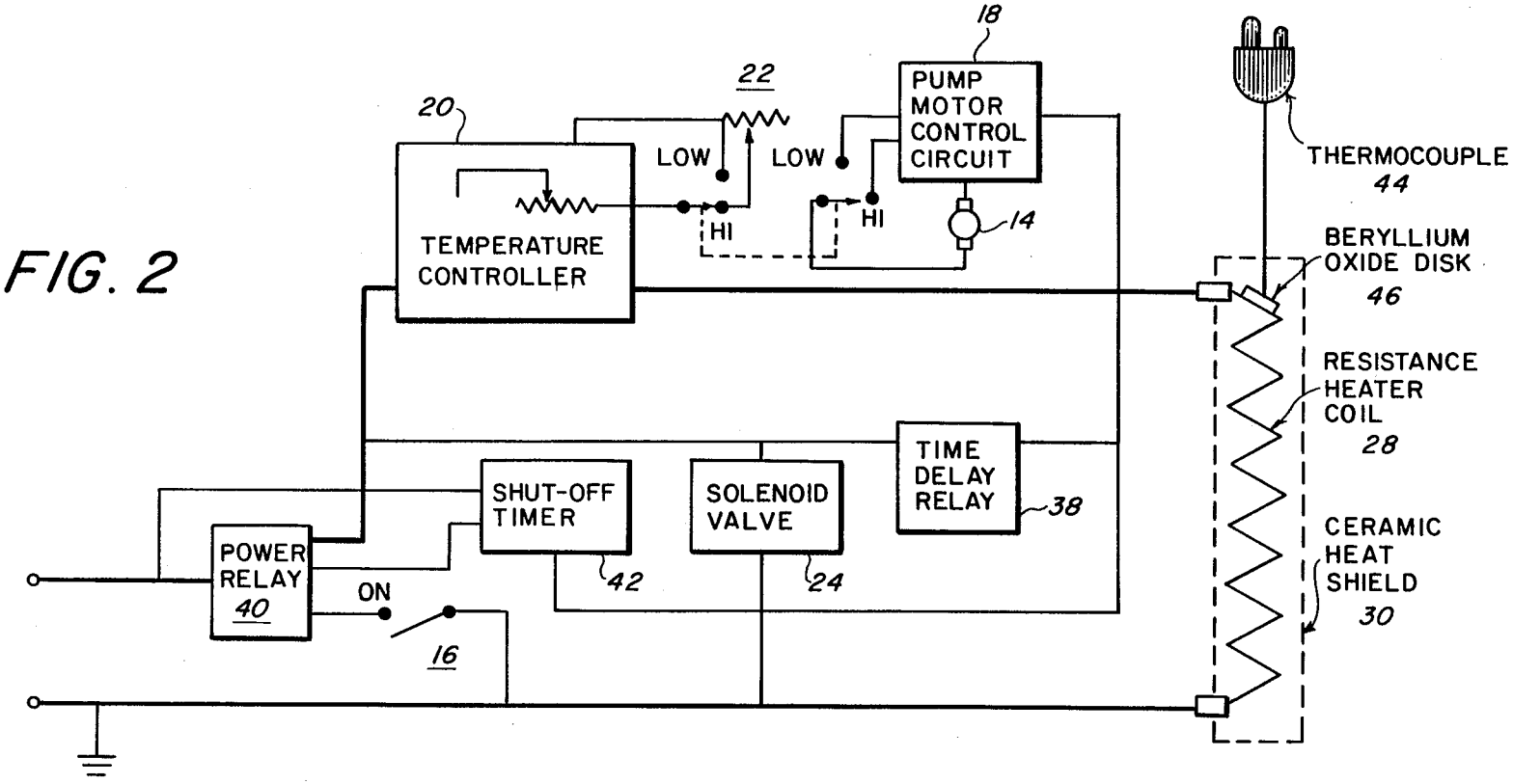
FIG. 2 is a schematic diagram of the electrical circuit of a preferred embodiment of the present invention.

FIG. 2 shows the heater circuit highlighted in bold lines. In the preferred embodiment it is adapted for 120 VAC at 15 amperes. Temperature controller 20 is selected or designed to maintain the temperature of the resistance heater coil 28 at the appropriate level to superheat the smoke agent regardless of the flow rate. A satisfactory controller for the preferred embodiment is Model AD7 from Fluid Kinetics, Inc., heretofore used as a temperature controller for stainless steel wire. It senses the resistivity of resistance heater coil 28 as part of a bridge circuit, and regulates the average current necessary to maintain the appropriate resistance heater coil temperature. The controller selected should be chosen for its compatibility with the material of resistance heater coil 28.

The circuit of FIG. 2 may include a ground line integrity monitor to detect inordinate ground leakage, and disconnect the line voltage when such leakage is detected. The monitor is a safety feature that will prevent the apparatus from operating if the ground line is missing or electrical polarity is incorrect. Also included may be a relay that is coupled to temperature controller 20, to disable the apparatus at power relay 40 if a fault occurs in the control circuit. And, included is preheat or time delay timer 38 that delays the operation of pump 14 for an adjustable period after current has first been coupled to resistance heater coil 28 until the temperature of resistance heater coil 28 is sufficient to superheat the smoke agent and avoid the emission of wet smoke. Shut-off timer 42 is adjustable and is intended to discontinue operation of the equipment before reservoir 12 becomes empty. The period associated with timer 42 is selectable up to 10 minutes in the preferred embodiment. Thermocouple 44 is useful for calibration, and may be adapted to provide a means for safety shut-down. It is electrically isolated from resistance heater coil 28 by beryllium oxide disk 46. Beryllium oxide is both a good electrical insulator and a good thermal conductor.

Resistance heater coil 28 is coiled stainless steel tubing in the preferred embodiment. Stainless steel can be selected to provide sufficient resolution of electrical resistivity to temperature permitting its use to satisfy the multiple functions intended in the invention for resistance heater coil 28. Stainless steel 304 provides a resolution of 2 ohms per 500 degrees, for example. In the preferred embodiment, thirty-five feet of one-eighth inch by five-thousandths tubing is used. In addition, resistance heater coil 28 preferably is encapsulated by potting with a high temperature insulation, such as moldable ceramic material 360-M from Cotronics Corporation. The insulation is shown in FIG. 1 as heat shield 30.

Coil 28 acts as a temperature sensing element in conjunction with temperature controller 20 that senses the resistivity of coil 28 as part of a bridge circuit in Model AD7 from Fluid Kinetics, Inc., and regulates the average current necessary to maintain the appropriate set coil temperature to superheat the smoke agent, regardless of the flow rate. Thermocouple 44 is useful for calibration. A thermocouple is defined by Webster's dictionary as a device for measuring temperature in which two electrical conductors of dissimilar metals are joined at the point whereat heat is to be applied and the free ends are connected to an electrical measuring instrument which by registering the amount of thermoelectric current being produced at the juncture of the dissimilar conductors indicates the temperature at that point. In addition to its use for calibration, thermocouple 44 could be adapted to provide a means for safety shut-down.

From the foregoing, it may readily be seen that the present invention comprises a new, unique, and exceedingly useful portable smoke generator which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. Apparatus for generating smoke from a preselected fluid by feeding the fluid to a tubular conduit in which the fluid is heated to a temperature sufficient to convert the fluid to vapor, wherein the conduit is maintained at a constant preselected temperature correlated to the resistivity of the conduit that is thereafter sensed to regulate current flow throught the conduit, comprising:

a tubular conduit defining a resistance heater coil functional in said apparatus as said conduit for conveying a smoke generation fluid and for heating the fluid, said coil having an electrical resistivity that varies with temperature and having a first open end defining an input orifice and a second open end defining an output orifice;

a beryllium oxide ceramic disk attached in heat exchange relationship to said coil;

a thermocouple attached to said disk in heat exchange relationship thereto and arranged to sense the temperature of said coil for calibration purposes;

said disk electrically insulating said thermocouple from said coil and thermally conducting the temperature of said coil to said thermocouple;

electrical circuit means connected to the ends of said coil for supplying electrical current thereto for heating said coil to a temperature sufficient to superheat said coil, said circuit means including an adjustable temperature controller including means for sensing the resistivity of the coil and regulating means responsive to the sensed resistivity of the coil for regulating the current supplied to the coil to thereby maintain the coil at a preselected temperature; and, means for storing the fluid, and for providing the fluid to said first open end of the coil, including a fluid reservoir, a conduit coupling said reservoir to said first open end of said coil, and a pump in said conduit and a normally closed valve downstream said pump;

such that said circuit means maintains a temperature at said output orifice of said coil that is optimal for superheating the fluid to vapor.

2. The apparatus of claim 1 further comprising a heat shield in which said coil is encapsulated, providing high temperature insulation for said coil.

3. The apparatus of claim 2 wherein said heat shield is ceramic.

4. The apparatus of claim 1 wherein said circuit means includes a power relay operable to activate said circuit means, and an adjustable shut-off timer connected to said power relay to disengage said relay upon the passage of a preselected period of time.

5. The apparatus of claim 4 wherein said circuit means includes a time delay means responsive to activation of said circuit means and coupled to said pump for delaying operation of said pump a preselected period of time during which said coil is heated to a superheat temperature.

* * * * *